US006260403B1

(12) United States Patent
Johnston

(10) Patent No.: US 6,260,403 B1
(45) Date of Patent: Jul. 17, 2001

(54) METHOD AND APPARATUS FOR ARCHING LARGE DIAMETER PIPES

(76) Inventor: Scott E. Johnston, 16857 Hummingbird La., Cottonwood, CA (US) 96022

( * ) Notice: Subject to any disclaimer, the term of this patent is extended or adjusted under 35 U.S.C. 154(b) by 0 days.

(21) Appl. No.: 09/312,990

(22) Filed: May 17, 1999

Related U.S. Application Data

(60) Provisional application No. 60/085,777, filed on May 18, 1998.

(51) Int. Cl.[7] ..... B21D 39/20
(52) U.S. Cl. ..... 72/393; 72/370.08
(58) Field of Search ..... 72/392, 393, 370.08, 72/370.23

(56) References Cited

U.S. PATENT DOCUMENTS 2,474,887 7/1949 Carswell et al. .
3,996,783 12/1976 Meserole .
4,007,622 * 2/1977 Galperin et al. ..... 72/369
4,914,939 4/1990 Brinegar .
4,974,440 12/1990 Brinegar .
5,826,457 * 10/1998 Eagles ..... 72/370.08

FOREIGN PATENT DOCUMENTS 0 428 355 * 5/1991 (EP) ..... 72/393

* cited by examiner

*Primary Examiner*—Lowell A. Larson

(57) ABSTRACT

A pipe arching apparatus, comprising an internal means for flattening and elongating the lower circumference of a pipe, while said pipe is positioned upon the ground. The apparatus is retractably compactible to be towably transportable and will arch pipes of larger size and longer lengths than traditional pipe arching equipment.

It is powered by an internal combustion engine, has hydraulically extendible radius forms for forcibly reshaping the inside of a pipe, and is steerably drivable into and out of a pipe.

7 Claims, 5 Drawing Sheets

METHOD AND APPARATUS FOR ARCHING LARGE DIAMETER PIPES

CROSS-REFERENCE TO RELATED APPLICATIONS

This application claims the benefit of provisional patent application No. 60/085,777 Filed May 18, 1998.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

This invention relates to pipe arching apparatus, and more particularly to a pipe arching apparatus that flattens and elongates the lower circumference of a pipe positioned directly upon the ground.

Arched pipe is used for highway drainage systems and various other construction projects where diversion of water flow or drainage of runoff is required. Full round pipe is suitable for most applications. However, sometimes it is beneficial to use a round pipe that has been forcibly widened at the bottom to increase the water flow area.

Prior pipe arches have been formed in the factory, either by an external pipe arching apparatus or by an internal pipe arching apparatus. To affect external pipe arching, force is applied directly to the external surface of the pipe to compress it until a desired shape is obtained. Although pipe arched by an external pipe arching apparatus is suitable for some applications, the act of forcibly reshaping the outer circumference could structurally weaken the pipe. A more uniform arch can be obtained by using an internal pipe arching apparatus.

A typical internal pipe arching apparatus utilizes a horizontal beam, with longitudinally extending radius forms mounted on opposite sides of the beam. The beam is about 25 feet long. The radius forms are extendible in opposite directions in a horizontal plane to forcibly reform the internal side walls of a pipe section that is suspended on the beam. As the side walls of the pipe are stretched to flatten the bottom of the pipe, some stretching and flattening of the upper pipe circumference also occurs which could structurally weaken the pipe.

A recent attempt was made to produce a pipe arching apparatus that could be used at the job site. The apparatus featured the typical horizontal beam arrangement, with a forklift truck at one end and a wheel support arrangement at the other. This apparatus could not be readily transported to the job site due to size and weight considerations. Additionally, it could not be self propelled to the job site unless the job site was within a very short distance. Even if it were practical to get this apparatus to the job site, it would only be able to arch a pipe of a size it could lift into arching position.

BRIEF SUMMARY OF THE INVENTION

The invention comprises an apparatus for arching pipe that forcibly flattens and elongates the internal lower circumference of a pipe that is positioned upon the ground. The machine includes a set of wheels at the front and rear of a horizontal beam arrangement, to create a structure that is substantially similar in size and shape to existing trucking industry trailer designs. The beam is about 15 feet long between the wheels. Extendible radius forms are mounted on opposite sides of the beam. The radius forms are extendible in opposite directions, vertically and horizontally, allowing forming in the lower circumference prior to forcibly reforming the internal side walls of the pipe. The machine can be repositioned within the pipe and the steps of flattening and elongating the lower circumference can be repeated as many times as necessary to arch the entire pipe length.

It is the principal object of the present invention to provide an apparatus for arching pipes that is readily transportable and is not limited by the same size and length considerations of traditional pipe arching equipment.

This and other advantages of the present invention will become apparent from following the detailed description taken in conjunction with the accompanying drawings.

DETAILED DESCRIPTION OF THE INVENTION

Figure 2:
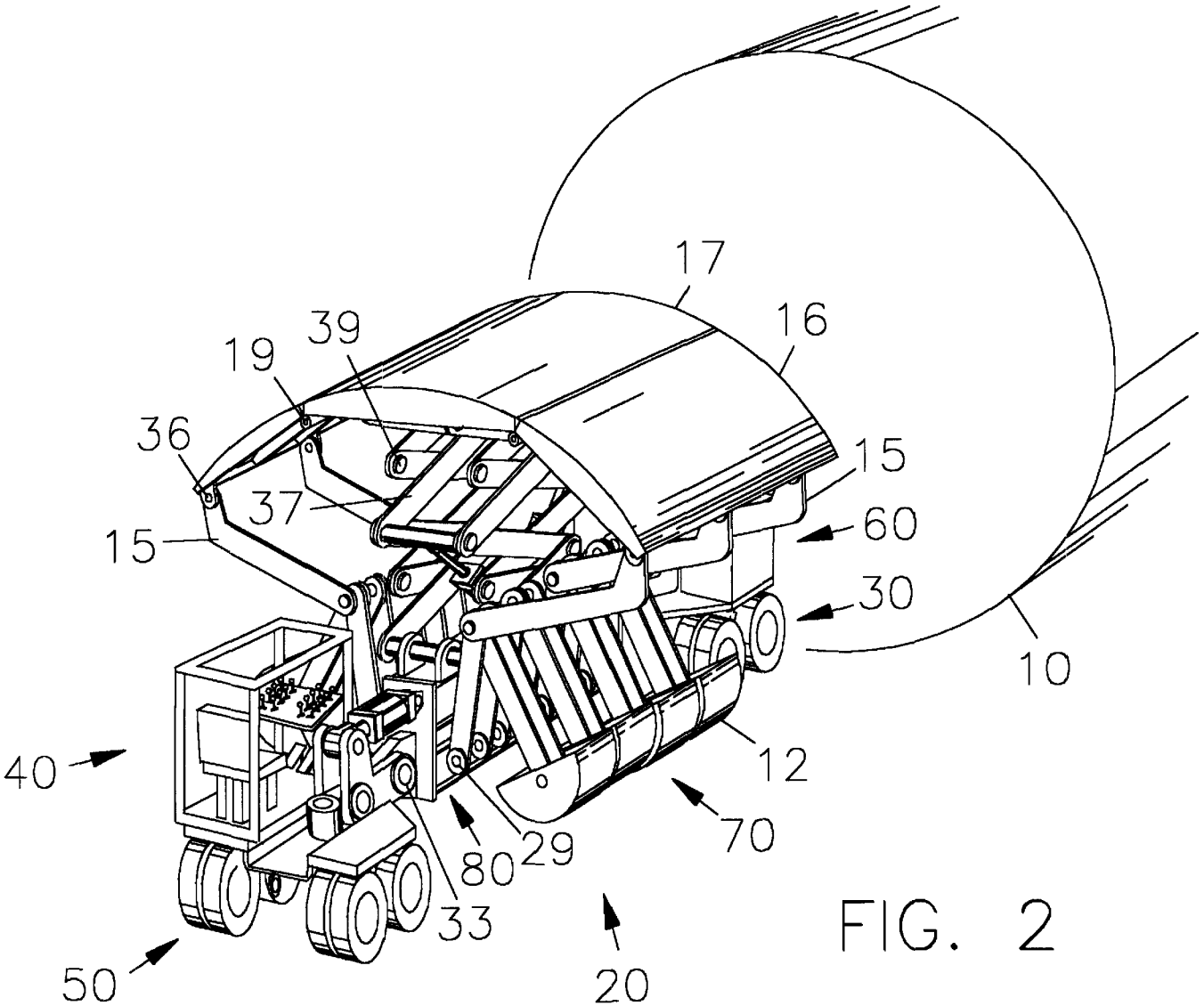
FIG. 2 is a perspective view of the pipe arching machine shown in a partially extended position just before entering a piece of round pipe.
Figure 4:
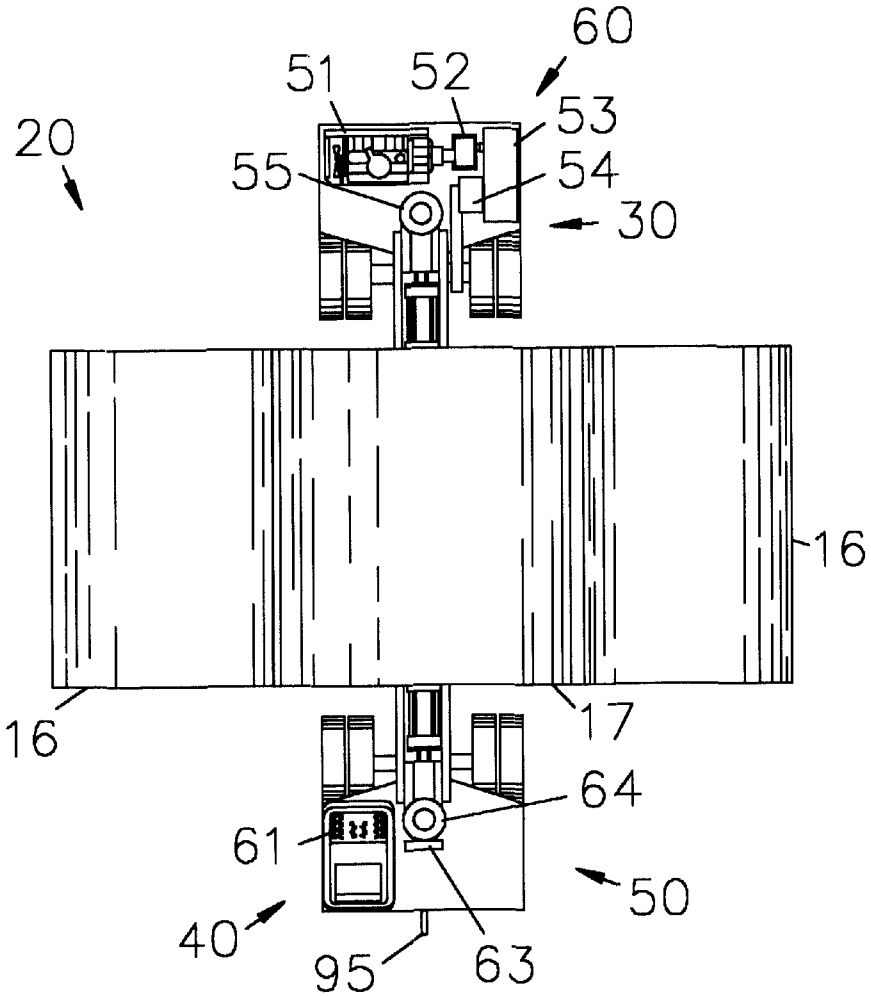
FIG. 4 is a top view of the pipe arching machine as shown partially extended.

Referring now in detail to the drawings, the present invention, a pipe arching apparatus as shown in FIGS. 2 and 4, includes a plurality of radius forms 70, pivotably attached with pivot pins 29, to an elongated weldment beam structure 80. The beam structure 80 is connected with pivot pin 55, to a wheel carriage 30 at one end, and pivotably connected with pivot pin 64, to wheel carriage 50 at the other end. An operator platform 40, with controls 61 is mounted to the surface of wheel carriage 50, with a hydraulic rack and pinion 63 connected at pin 64 to make wheel carriage 50 steerable. Means for producing rotational energy 60, is mounted to the surface of wheel carriage 30, and includes; an internal combustion engine with transmission 51, rotationally coupled to a gearbox 52, which is rotationally coupled to a hydraulic power supply 53 including a hydraulic motor 54 to provide means for controllably coupling said rotational energy to wheel carriage 30.

Figure 1:
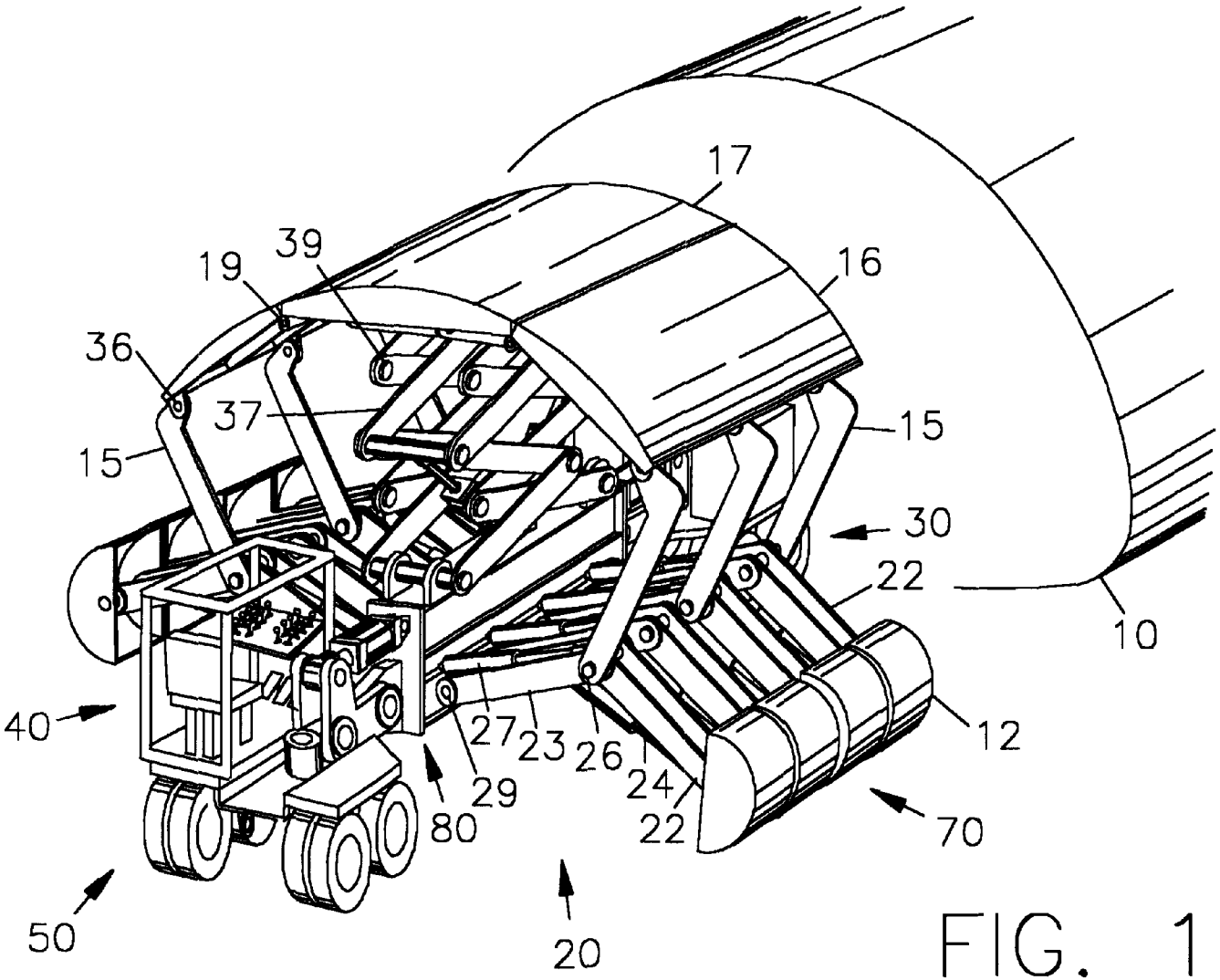
FIG. 1 is a perspective view of the pipe arching apparatus shown in a fully extended position just after exiting a piece of arched pipe.
Figure 5:
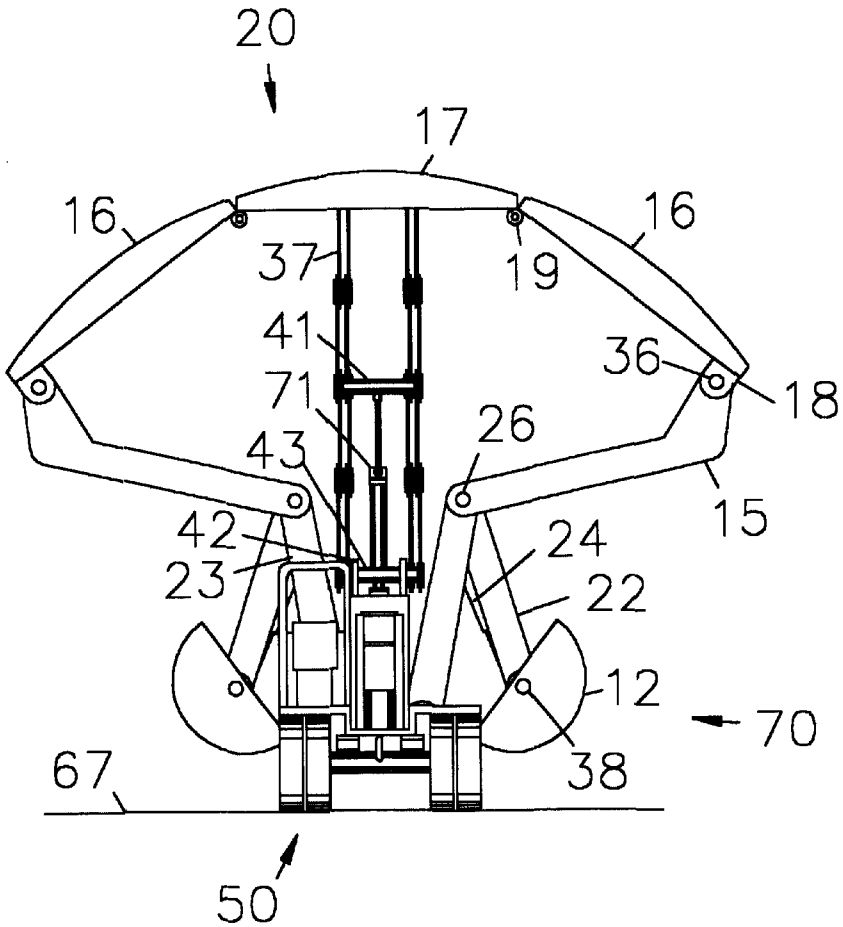
FIG. 5 is a front view of the pipe arching machine as shown partially extended.

Referring now to FIGS. 1 and 5, Radius forms 70, includes; form shoes 12, attached with pivot pins 38 to outer elongated supports 22 which are connected with pivot pins 26 to inner elongated supports 23. Outer supports 22 are actuated by hydraulic cylinders 24, which are end clevis mounted to inner supports 23 and rod clevis mounted to outer supports 22. Inner supports 23 are attached to beam structure 80 with pivot pins 29, and are actuated by hydraulic cylinders 27 which are end clevis mounted to beam structure 80 and rod clevis mounted to inner supports 23.

Figure 6:
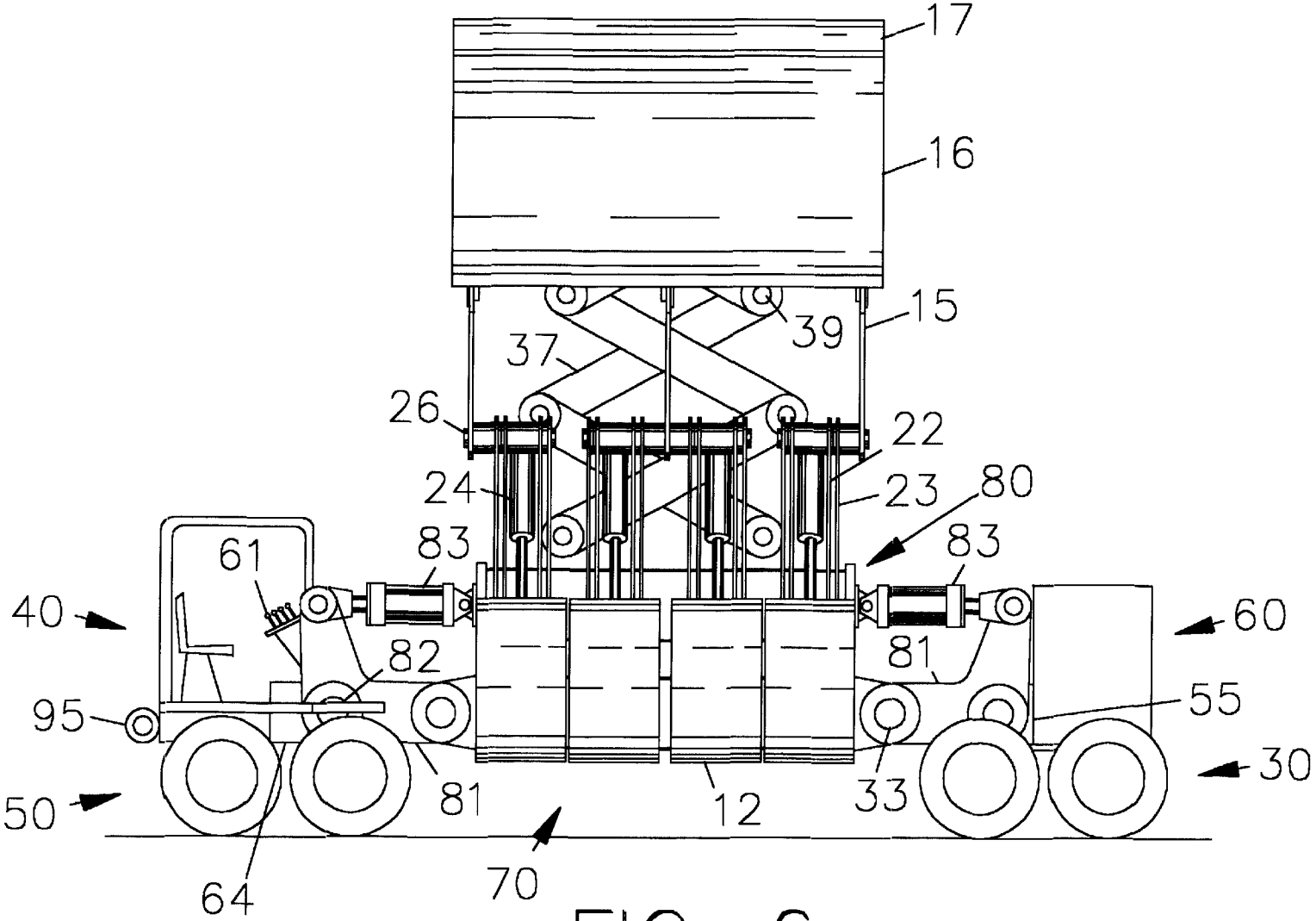
FIG. 6 is a side view of the pipe arching machine as shown partially extended.

The elongated beam structure 80, as most clearly shown in FIGS. 1, 5 and 6 includes; vertical articulation links 81 connected with pivot pins 33 at both ends of beam structure 80. Pivot pins 82 connect links 81 with wheel carriage 50 at pivot pin 64 and with wheel carriage 30 at pivot pin 55. Hydraulic cylinders 83 are end clevis mounted to beam structure 80 and rod clevis mounted to the vertical articulation links 81. The articulation links 81 are provided to allow for vertical adjustment of beam structure 80. Upper pipe form 17, and side pipe forms 16 are pivotably connected at 19 to provide a hinged canopy structure. The underside of form 17 and upper surface of beam structure 80 are provided with pivot connectors 42 and pivot pins 43, which are used to connect a series of pivot links 37 to form a scissor lift arrangement. A hydraulic cylinder 71 is end clevis mounted to the upper surface of beam structure 80 and rod clevis mounted to canopy pivot pin 41. Cylinder 71 is used to raise and lower the scissor lift arrangement. Swing out arms 15 are pivotably connected to pipe forms 16 with pivot connectors 18 and pivot pins 36. The opposite end of swing out arms 15 are interconnected to radius forms 70 with pivot pins 26. As the scissor lift arrangement is raised the swing out arms 15 cause pipe forms 16 to swing up and out in relationship to beam structure 80.

Referring now to FIGS. 1 and 2, the pipe arching apparatus 20, is shown in front of a piece of pipe 10 before being reshaped into an arch shape in FIG. 2 and after being reshaped into an arch shape in FIG. 1. The pipe arching apparatus 20 as shown in FIG. 2 is driven into a pipe 10 that is positioned upon the ground. At a point where the radius forms 70 are inside pipe 10, the radius forms 70 are hydraulically extended down into contact with the lower circumference of pipe 10 to forcibly begin to flatten out the radius. The beam structure 80 may also be lowered at this time to bring the full weight of the pipe arching apparatus 20 into contact with the bottom of the pipe 10 if needed. The act of flattening the lower circumference of pipe 10, results in the upper circumference being lowered proportionally. The radius forms 70 are then extended in opposite directions laterally into the pipe wall to forcibly elongate the lower circumference of pipe 10 until the desired arch shape is achieved. The steps of flattening and elongating the lower circumference may be repeated as necessary to achieve the desired arch shape and the pipe arching apparatus 20 can be progressively moved through a length of pipe 10 repeating these steps as many times as needed. The upper pipe form 17 and side pipe forms 16 help to avoid elongating the lower circumference beyond the desired arch shape. As the upper radius of pipe 10 comes into contact with pipe form 17 the arching process is completed. The upper circumference of the pipe retains a consistent radial form since the area that needs to be reformed is the only area that is reformed using the method of flattening and elongating the lower circumference of a pipe while the pipe is positioned upon the ground.

Figure 3:
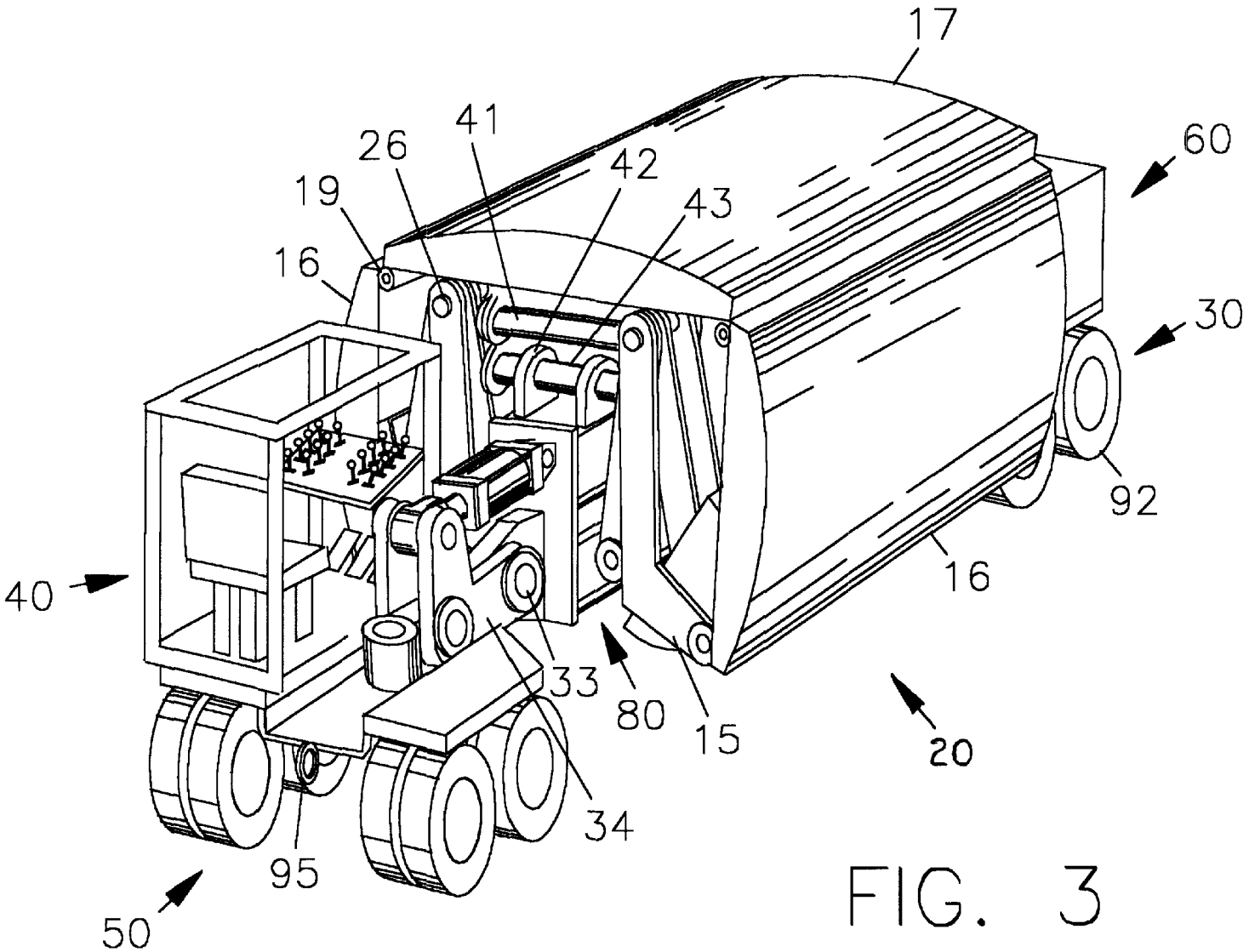
FIG. 3 is a perspective view of the pipe arching machine shown in a completely retracted position to be towably transportable.

Referring now to FIG. 3 the pipe arching apparatus 20 is shown fully retracted. Side pipe forms 16 conceal radius forms 70 (not shown), upper form 17 conceals the scissor lift arrangement, and the complete arching apparatus 20 is now compact for transport. A tow hook 95 is provided to make the arching apparatus towably transportable.

Various changes and modifications may be made in carrying out the present invention without departing from the spirit and scope thereof. Insofar as these changes and modifications are within the purview of the appended claims, they are to be considered as part of the invention.

I claim:

1. A pipe arching apparatus, comprising an internal means for flattening and elongating the lower circumference of a pipe, while said pipe is positioned upon the ground.

2. The combination of claim 1, further including a plurality of wheels at each end of said apparatus, whereby said apparatus is movable within the length of said pipe.

3. The combination of claim 2, further including an internal combustion engine for producing rotational energy and means for controllably coupling rotational energy from said engine to said plurality of wheels.

4. The combination of claim 3, wherein said means for controllably coupling rotational energy, includes a hydraulic power supply.

5. The combination of claim 1, wherein said internal means for flattening and elongating the lower circumference of said pipe, includes; a plurality of hydraulically extendible elongated supports with pivotably attached radius forms.

6. A method of arching a pipe, comprising the steps of internally flattening and elongating the lower circumference of said pipe, while said pipe is positioned upon the ground.

7. The method of claim 6, further including the step of moving within the length of said pipe, to repeat said steps of internally flattening and elongating, whereby said pipe may be longer in length than could be arched by methods used in the past.

* * * * *